United States Patent [19]

Braun et al.

[11] 4,002,776

[45] Jan. 11, 1977

[54] IMAGING PROCESS EMPLOYING TONER PARTICLES CONTAINING ARYLSULPHONAMIDE FORMALDEHYDE ADDUCT

[75] Inventors: Robert A. Braun; Robert Mermelstein, both of Rochester, N.Y.

[73] Assignee: Xerox Corporation, Stamford, Conn.

[22] Filed: Jan. 21, 1975

[21] Appl. No.: 542,744

Related U.S. Application Data

[62] Division of Ser. No. 336,158, Feb. 26, 1973, Pat. No. 3,893,934.

[52] U.S. Cl. ..... 427/19; 96/1 SD; 427/14

[51] Int. Cl.[2] ..... G03G 9/02

[58] Field of Search ..... 427/14, 20, 19; 252/62.1; 96/1 SD; 260/30 P

[56] References Cited

UNITED STATES PATENTS

| | | | |
|---|---|---|---|
| 2,244,183 | 6/1941 | Austin | 260/30.8 R X |
| 3,377,286 | 4/1968 | Sticklin | 252/62.1 |
| 3,740,334 | 6/1973 | Jacknow et al. | 252/62.1 |
| 3,775,326 | 11/1973 | Westdale | 252/62.1 |

OTHER PUBLICATIONS

Santolite MHP, Technical Bulletin O–D–112, May 25, 1950, Monsanto Chemical Company.

Santolite MHP and Santolite MS–80% (Monsanto Industrial Resins) Monsanto Technical Bulletin No. 0–94, Apr., 1953, pp. 2–11.

*Primary Examiner*—Harry J. Gwinnell
*Assistant Examiner*—Stuart D. Frenkel

[57] ABSTRACT

An electrostatographic imaging process comprising the steps of forming an electrostatic latent image on a surface and developing said image by contacting it with an electrostatographic developer material comprising particles, the particles including finely-divided toner material have a particle size of up to about 30 microns, a melting point of at least about 110° F, a melt viscosity of less than about $2.5 \times 10^{-4}$ poise at temperatures up to about 450° F, the toner material comprising a colorant, a thermoplastic resin consisting essentially of a vinyl polymer having a melting point of at least about 110° F, and from about 5 percent to about 55 percent by weight, based on the weight of the vinyl polymer, of an arylsulfonamide formaldehyde adduct having a melting point between about 50° F and about 250° F, whereby at least a portion of the toner material is attracted to and held on the surface in conformance to the electrostatic latent image.

10 Claims, No Drawings

IMAGING PROCESS EMPLOYING TONER PARTICLES CONTAINING ARYLSULPHONAMIDE FORMALDEHYDE ADDUCT

This application is a divisional application of application Ser. No. 336,158, filed on Feb. 26, 1973, now U.S. Pat. No. 3,893,934.

BACKGROUND OF THE INVENTION

This invention relates to imaging systems, and more particularly, to improved electrostatographic developing materials, their manufacture and use.

The formation and development of images on the surface of photoconductor materials by electrostatic means is well known. The basic xerographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting electrostatic latent image by depositing on the image a finely divided electrocopic material referred to in the art as "toner." The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing steps.

Several methods are known for applying the electroscopic particles to the electrostatic latent image to be developed. One development method, as disclosed by E. N. Wise in U.S. Pat. No. 2,618,552, is known as "cascade" development. In this method, a developer material comprising relatively large carrier particles having finely divided toner particles electrostatically coated thereon is conveyed to and rolled or cascaded across the electrostatic latent image bearing surface. The composition of the carrier particles is so selected as to triboelectrically charge the toner particles to the desired polarity. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier and excess toner are then recycled. This technique is extremely good for the development of line copy images.

Another method of developing electrostatic images is the "magnetic brush" process as disclosed, for example, in U.S. Pat. No. 2,874,063. In this method, a developer material containing toner and magnetic carrier particles are carried by a magnet. The magnetic field of the magnet causes alignment of the magnetic carrier into a brush-like configuration. This "magnetic brush" is engaged with the electrostatic image-bearing surface and the toner particles are drawn from the brush to the latent image by electrostatic attraction.

Still another technique for developing electrostatic latent images is the "powder cloud" process as disclosed, for example, by C. F. Carlson in U.S. Pat. No. 2,221,776. In this method a developer material comprising electrically charged toner particles in a gaseous fluid is passed adjacent the surface bearing the electrostatic latent image. The toner particles are drawn by electrostatic attraction from the gas to the latent image. This process is particularly useful in continuous tone development.

Other development methods such as "touchdown" development, as disclosed by R. W. Gundlack in U.S. Pat. No. 3,166,432, may be used where suitable.

The developed image can then be read or permanently affixed to the imaging surface of the photoconductive substrate if this imaging surface is not to be reused. In the event that the imaging surface is of a reusable material and is to be used in preparation of subsequent electrostatographic copies, the developed image can be transferred to another substrate, such as paper, and then permanently affixed thereto. Various techniques have been devised to permanently affix this toner image to its substrate including overcoating the toner image with a transparent film, and solvent or thermal fusion of the tone particles to the substrate material. The energy requirements involved in thermal fixation of the toner are considerable since these thermoplastic toner materials often require temperatures in the range of 350°–400° F and higher to fuse them to the substrate. Thus, a substantial reduction in the fusion temperatures of the toner would result in a corresponding reduction in energy requirements of such an imaging process. Any reduction in the fusion temperature of the toner would also permit lowering the operating temperatures within the copier and, therefore, reduce the demands placed upon the temperature control unit within such an apparatus.

Although some of the foregoing development techniques are employed commercially today, the most widely used commercial electrostatographic development technique is the technique known as "cascade" development. A general purpose office copying machine incorporating this development process is described in U.S. Pat. No. 3,099,943. The cascade technique is generally carried out in a commercial apparatus by cascading a developer mixture over the upper surface of an electrostatic latent image-bearing drum having a horizontal axis. The developer is transported from a trough or sump to the upper portion of the drum by means of an endless belt conveyor. The developer is cascaded downward along a portion of the surface of the drum into the sump and is subsequently recycled through the developing system to develop additional electrostatic latent images. Small quantities of toner are periodically added to the developing mixture to compensate for the toner depleted by development. This process is then repeated for each copy produced by the machine and is ordinarily repeated many thousands of times during the usable life of the developer.

Thus, it is apparent from the description presented above, as well as in other development techniques, that the toner is subjected to mechanical attrition which tends to break down the particles into undesirable dust fines. Toner fines are detrimental to machine operation because they are extremely difficult to remove from reusable imaging surfaces and also because they tend to drift to other parts of the machine and deposit on critical machine parts such as optical lenses. The formation of fines is retarded when the toner contains a tough, high molecular weight resin which is capable of withstanding the shear and impact forces imparted to the toner in the machine. Unfortunately, many high molecular weight materials cannot be employed in high speed automatic machines because they cannot be rapidly fused during a powder image heat fixing step. Attempts to rapidly fuse a high melting point toner by means of oversized high capacity heating units have been confronted with the problems of preventing the charring of paper receiving sheets and of adequately dissipating the heat evolved from the fusing unit or units. Thus, in order to avoid charring or combustion, additional equipment such as complex and expensive cooling units are necessary to properly dispose of the large quantity of heat generated by the fuser. Incomplete removal of the heat evolved will result in operator discomfort and damage to heat-sensitive machine components. Further, the increased space occupied by and the high operating cost of the heating and cooling units, often outweigh the advantages achieved by the increased machine speed. On the other hand; low molecular weight resins which are easily heat fused at relatively low temperatures are often undesirable because these materials tend to form thick films on reusable photoconductor surfaces. These films tend to cause image degradation and contribute to machine maintenance down time. In addition, low molecular weight resins tend to form tacky images on the copy sheet which often offset to other adjacent sheets. Further, toner particles containing low molecular weight resins tend to bridge, cake, and block in the shipping container as well as in the xerographic machine. Also, the toner material must be capable of accepting a charge of the correct polarity when brought into rubbing contact with the surface of carrier materials in cascade, magnetic brush or touch-down development systems. Some resinous materials which possess many properties which would be desirable in xerographic toners dispense poorly and cannot be used in automatic copying and duplicating machines. Other resins dispense well but form images which are characterized by low density, poor resolution, or high background. Further, some resins are unsuitable for processes where electrostatic transfer is employed. Many thermoplastic materials, such as those presently in use in electrostatographic toners, have traditionally been difficult to mold or form because of unfavorable rheological properties. probably the most widely accepted technique for modification of these thermoplastics to facilitate forming of such materials has been the inclusion of certain additives in said materials designed to reduce their melt viscosity. These additives, generally referred to in the art as "plasticizers", include non-volatile organic liquids or low melting solids, e.g. phthalate, adipate and sebcate esters and aryl phosphate esters.

The interaction of the plasticizer and the resin in the melt results in a marked improvement in the composition's rheological properties by affecting a shift in both the glass transition temperature and fusion points of the composition to lower temperatures. This shift in the glass transition temperature of the thermoplastic materials used as electrostatographic toners, is substantial, can cause these discrete, finely-divided toner particles to form larger agglomerates. This agglomeration, more commonly referred to in the electrostatographic art as "blocking", adversely affects the free-flow characteristics of the toner. For example, in cascade-type development systems, the momentum of these larger toner particles as they tumble over the imaging member can exceed the attractive forces of the latent image and, therefore, result in failure of development of the latent image by these larger toner particles. Since most thermoplastic materials are deficient in one or more of the above areas, there is a continuing need for improved toners and developers.

SUMMARY OF THE INVENTION

It is, therefore, an object of this invention to provide a toner overcoming the above noted deficiencies.

It is another object of this invention to provide a toner which is resistant to film formation when employed in conventional xerographic copying and duplicating devices.

It is another object of this invention to provide a xerographic toner which forms images having reduced background.

It is another object of this invention to provide a free flowing toner which is resistant to agglomeration.

It is another object of this invention to provide a xerographic toner which can be fused at higher rates with less heat energy.

It is another object of this invention to provide a xerographic toner which forms high resolution images.

It is another object of this invention to provide a xerographic toner which is resistant to mechanical attrition during the development process.

It is another object of this invention to provide a xerographic toner having improved dispensing characteristics.

It is another object of this invention to provide a modified toner composition which has a fusion temperature substantially less than that of its unmodified counterpart and which yet remains relatively unchanged with respect to its glass transition temperature.

It is another object of this invention to provide improved imaging processes employing one of the modified toner compositions of this invention.

It is another object of this invention to provide a toner and developer having physical and chemical properties superior to those of known toners and developers.

The above objects and others are accomplished by providing a finely-divided low melting toner comprising a colorant, a thermoplastic resin comprising a vinyl resin, and at least one arylsufonamide formaldehyde adduct having the general structure

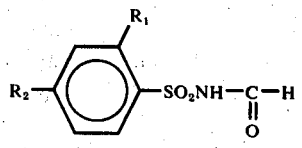

wherein $R_1$ and $R_2$ are either hydrogen or methyl provided that where $R_1$ or $R_2$ is methyl, the other is hydrogen.

This invention also embraces imaging processes in which said improved toner compositions are employed and a method for the reduction of the fusion temperature of thermoplastic materials, while at the same time having such materials remain relatively unchanged with respect to their glass transition temperature.

For optimum operation in high speed electrostatographic machines employing paper receiving webs, the toner should have a melting range between about 110° F to about 300° F and a melt viscosity of less than about $2.0 \times 10^{-4}$ poise up to temperatures of about 300° F. Toner melting temperatures below about 300° F are preferred because heat dissipation and paper degradation problems are avoided. The developers of this invention containing said improved toner compositions are characterized by outstanding fusing rates, high cleanability from electrostatic imaging surfaces, greater triboelectric stability, denser toner images, and increased resistance to mechanical attrition. Unexpectedly, both the fire hazard and excessive power consumption problems encountered in high speed electrostatographic development processes are obviated when toners containing the above-described arylsulfonamide formaldehyde adducts are employed.

Any suitable vinyl resin having a melting point of at least about 110° F may be employed in the toners of this invention. The vinyl resin may be a homopolymer or a copolymer of two or more vinyl monomers. Typical monomeric units which may be employed to form vinyl polymers include: styrene, p-chlorostyrene; vinyl naphthalene; ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2 chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidene and the like; and mixtures thereof. Generally, suitable vinyl resins employed in the toner have a weight average molecular weight between about 3,000 to about 500,000.

Toner resins containing relatively high percentages of a styrene resin are preferred. The presence of a styrene resin is preferred because a greater degree of image definition is achieved with a given quantity of adduct material. Further, denser images are obtained when at least about 25 percent by weight, based on the total weight of resin in the toner, of a styrene resin is present in the toner. The styrene resin may be a homopolymer of styrene or styrene homologues or copolymers of styrene with other monomeric groups containing a single methylene group attached to a carbon atom by a double bond. Thus, typical monometric materials which may be copolymerized with styrene by addition polymerization include: p-chlorostyrene; vinyl naphthalene; ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alpha-methylene aliphatic monocarboxylic acids such as methyl acrylate, ethyl acrylate, n-butylacrylate, isobutyl acrylate, dodecyl acrylate, n-octyl acrylate, 2-chloroethyl acrylate phenyl acrylate, methyl-alpha-chloroacrylate methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like, vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidene and the like; and mixtures thereof. The styrene resins may also be formed by the polymerization of mixtures of two or more of these unsaturated monomeric materials with a styrene monomer. The expression "addition polymerization" is intended to include known polymerization techniques such as free radical, anionic and cationic polymerization processes.

The vinyl resins, including styrene type resins, may also be blended with one or more other resins if desired. When the vinyl resin is blended with another resin, the added resin is preferably another vinyl resin because the resulting blend is characterized by especially good triboelectric stability and uniform resistance against physical degradation. The vinyl resins employed for blending with the styrene type or other vinyl resin may be prepared by the addition polymerization of any suitable vinyl monomer such as the vinyl monomers described above. Other thermoplastic resins may also be blended with the vinyl resins of this invention. Typical non-vinyl type thermoplastic resins include: rosin modified phenol formaldehyde resins, oil modified epoxy resins, polyurethane resins, cellulosic resins, polyether resins and mixtures thereof. When the resin component of the toner contains styrene copolymerized with another unsaturated monomer or a blend of polystyrene and another resin, a styrene component of at least about 25 percent by weight based on the total weight of the resin present in the toner is preferred because denser images are obtained and a greater degree of image definition is achieved with a given quantity of adduct material.

The combination of the resin component, colorant, and adduct, whether the resin component is a homopolymer, copolymer, or blend, should have a blocking temperature of at least about 110° F and a melt vicosity of less than about $2.5 \times 10^{-4}$ poise temperatures up to about 450° F. When the toner is characterized by a blocking temperature less than about 110° F, the toner particles tend to agglomerate during storage and machine operation and also form undesirable films on the surface of reusable photoreceptors which adversely affect image quality. If the melt viscosity of the toner is greater than about $2.5 \times 10^{-4}$ poise at temperatures above about 450°F, the toner material of this invention generally does not adhere properly to a receiving sheet even under conventional electrostatographic machine fusing conditions and may easily be removed by rubbing.

The arylsulfonamide formaldehyde adducts in the preferred embodiments of this invention may be selected from the 2- methylbenzene sulfonamide formaldehyde adduct, the 4-methylbenzene sulfonamide formaldehyde adduct, and mixtures thereof. In addition, suitable sulfonamide formaldehyde adducts may be derived from N-cyclohexyl p-toluene sulfonamide, N-ethyl p-toluene sulfonamide, o-toluene sulfonamide, p-toluene sulfonamide, N,N-di-p-hydroxyethyl- p-toluene sulfonamide, N,N-dimethyl benzene sulfonamide, N-cyclohexyl benzene sulfonamide, N-cyclohexyl-3,4-dichlorobenzene sulfonamide, N-allyl p-toluene sulfonamide, N,N-di-p-hydroxyethyl p-toluene sulfonamide, N-cyclohexyl p-toluene sulfonamide and the like. These adducts are formed by condensation of arylsulfonamides with formaldehyde and generally have a melting point between about 50° F and about 250° F. Some of these adducts are sold under the "santolite" trademark by the Monsanto Company, St. Louis, Missouri, for example, Santolite MHP and Santolite MS-80%/ Generally, %. adduct is employed in an amount from about 5 percent to about 55 percent by weight based on the total weight of the resinous component of the toner. Preferably, the adduct is employed in an amount from about 10 percent to about 40 percent by weight based on the total weight of the resinous component of the toner because as the relative quantity of adduct in the toner is increased above about 60 percent, the mechanical strength, creep resistance, and permanency of the ultimate fused toner image begins to decrease rapidly. Thus, when brittle, non-polymeric compounds such as the compounds disclosed in U.S. Pat. No. 3,272,644 are employed in automatic copying and duplicating machines, extensive toner dust is formed and the fused toner images tend to crumble and flake off receiving sheets when the sheets are folded. Further, some solid non-polymeric materials tend to vaporize or sublime and form toxic or flammable fumes. When less than about 3 percent of the adduct is employed in the toner, the toner fusing, flow, and triboelectric properties are substantially the same as a toner which does not contain the adduct. If desired, mixtures of adduct may be employed in the toner. An increase in the relative quantity of adduct tends to reduce the melt viscosity of the ultimate toner. It has been found that the fusing point of toner compositions is generally correlative with the melt viscosity of polymer-toner compositions. In accordance with this invention, the melt viscosity of a polymer-toner composition may be lowered by the addition of a relatively low melting arylsulfonamide formaldehyde adduct thereto wherein said adduct does not significantly affect the glass transition temperature of the polymer-toner composition and hence the blocking temperature of the toner is not influenced. Thus, due to the substantial reduction in the fusion temperature of the toner compositions of this invention, imaging processes employing said toner compositions will have markedly reduced energy requirements with respect to the thermal fixation of developed toner images. In addition, the maintenance of relatively constant glass transition temperatures in said toner compositions also prevents agglomeration or "blocking" of the discrete, finely-divided toner particles in developer reservoirs. Although Applicant does not wish to be bound by any theory for the unexpected findings of this invention, it is hypothesized that that there may be two possible mechanisms for the results discovered. It is initially envisioned that the arylsulfonamide formaldehyde adduct functions as a solvent for the polymer-toner in the liquid state at elevated temperature but not in the solid state at ambient temperature. Alternatively, the adduct above its melting point and above the glass transition temperature of the toner resin permits sufficient deformation of the polymer to permit fixation at lower temperatures.

It is to be understood that the specific formulas given for the units contained in the adducts and resins of this invention represent the vast majority of the units present, but do not exclude the presence of other monomeric units or reactants than those which have been shown. For example, some commercial materials such as polystyrenes, and polychlorinated polyphenyl compounds contain trace amounts of homologues or unreacted or partially reacted monomers. Any minor amount of such substituents may be present in the materials of this invention.

Any suitable pigment or dye may be employed as the colorant for the toner particles. Toner colorants are well known and include, for example, carbon black, nigrosine dye, aniline blue, Calco Oil Blue, chrome yellow, ultra marine blue, duPont Oil Red, Quinoline Yellow, methylene blue chloride, phthalocyanine blue, Malachite Green Oxalate, lamp black, Rose Bengal and mixtures thereof. The pigment or dyes should be present in the toner in a sufficient quantity to render it highly colored so that it will form a clearly visible image on a recording member. Thus, for example, where conventional electrostatographic copies of typed documents are desired, the toner may comprise a black pigment such as carbon black or a black dye such as Amaplast Black dye, available from the National Aniline Products, Inc. Generally, the pigment is employed in an amount from about 1 percent to about 20 percent by weight based on the total weight of the colored toner. If the toner colorant employed is a dye, substantially smaller quantities of colorant may be used. However, since a number of the above pigments used in electrostatographic toner compositions may affect both the glass transition and fusion temperatures of the toner compositions of this invention, their concentration preferably should not exceed about 10 percent by weight of the colored toner.

The toner compositions of the present invention may be prepared by any well-known toner mixing and comminution technique. For example, the ingredients may be thoroughly mixed by blending, mixing and milling the components and thereafter micropulverizing the resulting mixture. Another well-known technique for forming toner particles is to spray-dry a ball-milled toner composition comprising a colorant, a resin, and a solvent.

Generally, the degree of quality of toner fix at a given fuser temperature decreases with an increase in toner melt vicosity. As discussed above, if the melt viscosity of the toners of this invention is greater than about 2.5 $\times 10^{-4}$ poise at temperatures above about 450°F, the toner materials do not adhere properly to a receiving sheet even under conventional electrostatographic machine fusing conditions. Thus, the melt viscosity value of the toners of this invention aids in the determination of the degree of flow and penetration of the toner into the surface of a receiving substrate such as paper during the heat fixing step. The expression "melt viscosity", as employed herein, is a measure of the ratio of shear stress to shear rate in poise at a given temperature. All viscosity measurements are determined using a Ferronti-Shirley Cine Anol Plate Viscometer.

When the toner mixtures of this invention are to be employed in a cascade development process, the toner should have an average particle size less than about 30 microns and preferably between about 4 and about 20 microns for optimum results. For use in powder cloud development methods, particle diameters of slightly less than 1 micron are preferred.

Suitable coated and uncoated carrier materials for cascade development are well known in the art. The carrier particles comprise any suitable solid material, provided that the carrier particles acquire a charge having an opposite polarity to that of the toner particles when brought in close contact with the toner particles so that the toner particles adhere to and surround the carrier particles. When a positive reproduction of the electrostatic images is desired, the carrier particle is selected so that the toner particles acquire a charge having a polarity opposite to that of the electrostatic image. Alternatively if a reversal reproduction of the electrostatic image is desired, the carrier is selected so that the toner particles acquire a charge having the same polarity as that of the electrostatic image. Thus, the materials for the carrier particles are selected in accordance with their triboelectric properties in respect to the electroscopic toner so that when mixed or brought into mutual contact, one component of the developer is charged positively if the other component is below the first component in the triboelectric series and negatively if the other component is above the first component in a triboelectric series. By proper selection of materials in accordance with their triboelectric effects, the polarities of their charge, when mixed, are such that the electroscopic toner particles adhere to and are coated on the surfaces of carrier particles and also adhere to that portion of the electrostatic image-bearing surface having a greater attraction for the toner than the carrier particles. Typical carriers include sodium chloride, ammonium chloride, aluminum potassium chloride, Rochelle salt, sodium nitrate, aluminum nitrate, potassium chlorate, granular zircon, granular silicon, methyl methacrylate, glass, silicon dioxide, nickel, steel, iron, ferrites, and the like. The carriers may be employed with or without a coating. Many of the foregoing and other typical carriers are described by L. E. Walkup et al. in U.S. Pat. No. 2,638,416 and E. N. Wise in U.S. Pat. No. 2,618,552. An ultimate coated carrier particle diameter between about 50 microns to about 1,000 microns is preferred because the carrier particles then possess sufficient density and inertia to avoid adherence to the electrostatic images during the cascade development process. Adherence of carrier beads to electrostatographic drums is undesirable because of the formation of deep scratches on the surface during the imaging transfer and drum cleaning steps, particularly where cleaning is accomplished by a web cleaner such as the web disclosed by W. P. Graff, Jr., et al. in U.S. Pat. No. 3,186,838. Also print deletion occurs when carrier beads adhere to electrostatographic imaging surfaces. Generally speaking, satisfactory results are obtained when about 1 part toner is used with about 10 to 200 parts by weight of carrier.

The toner compositions of the instant invention may be employed to develop electrostatic latent images on any suitable electrostatic latent image-bearing surface including conventional photoconductive surfaces. Well-known photoconductive materials include vitreous selenium, organic or inorganic photoconductors embedded in a non-photoconductive matrix, organic or inorganic photoconductors embedded in a photoconductive matrix, or the like. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. 3,121,007 to Middleton, and U.S. Pat. No. 3,151,982 to Corrsin.

DESCRIPTION OF THE PREFERRED EMBODIMENTS

The following examples further define, describe, and compare methods of preparing the toner materials of the present invention and of utilizing them to develop electrostatic latent images. Parts and percentages are by weight unless otherwise indicated.

EXAMPLE I

A control sample of about 1 part of a conventional toner composition comprising a mixture of styrene/n-butyl methacrylate copolymer, polyvinyl butyral, and carbon black as the colorant as disclosed in U.S. Pat. No. 3,079,342 is mixed with about 99 parts by weight of coated carrier beads as disclosed in U.S. Pat. No. 3,526,533 to form a developer mixture. The toner has a blocking temperature of about 130° F. Copies of a standard test pattern are made with the developer mixture in a modified Xerox 3600-III copying machine which are then passed through a standard Xerox 4000 fuser unit mounted externally to the Xerox 3600-III machine. The fuser temperature is regulated with a proportional temperature controller and is monitored by means of a thermocouple wherein the fuser temperature is varied in 10° F increments to determine the fix temperature for minimum acceptable fix and hot offset. The minimum fix level is established at 10 ± 2 "Taber Cycles". The term "Taber Cycles" represents the degree of fix obtained using a test method based on the resistance of a fixed toner image to abrasion with a Taber Abrader, Model 174, available from Welch Scientific Co. After passage through the fuser, the copy sheets are mounted on a specimen card having a diameter of about 4.25 inches and abraded using a standard CS-10 test wheel. The number of cycles required to result in about a 20 percent decrease in image density is recorded. A minimum fuser temperature is established when about a 20 percent decrease in image density is observed. Generally, an abrasion run of 10 ± 2 revolutions of the abrading wheel constitutes acceptable fusing. The minimum fuser temperature at which legible copies are obtained with this toner is found to be about 380° F. The maximum fuser temperature at which hot offset to the fuser roll occurs is found to be about 430° F.

EXAMPLE II

A toner composition is prepared comprising about 81 parts by weight of a copolymer of about 65 parts by weight of styrene and 35 parts by weight of butyl methacrylate, about 9 parts by weight of carbon black (Neo Spectra Mark II, available from Columbian Carbon Co.), and about 10 parts by weight of arylsulfonamide formaldehyde adduct (Santolite MHP, available from Monsanto Co.). After melting and preliminary mixing, the toner composition is fed to a rubber mill and thoroughly milled to yield a uniformly disperse composition of the carbon black in the resin body. the resulting mixture is then cooled and finely subdivided in a jet pulverizer to yield toner particles having an average particle size ranging between about 10 to about 20 microns. The toner has a blocking temperature of about 130° F. About 1 part of the pulverized toner particles are mixed with about 99 parts by weight of the carrier beads of Example I and substituted for the developer in the testing machine described in Example I. Under substantially identical test conditions, it is found that the minimum fuser temperature at which legible copies are obtained with this toner is about 325° F. The maximum fuser temperature at which hot offset to the fuser roll occurs is found to be about 410° F. These results clearly indicate that this toner enables a reduction of about 55° F from the fuser temperature required for the control sample of Example I. The toner dispenses well and high resolution images substantially free from background are obtained.

EXAMPLE III

A toner composition is prepared comprising about 71 parts by weight of copolymer of about 65 parts by weight of styrene and 35 parts by weight of butyl methacrylate, about 9 parts by weight of carbon black (Neo Spectra Mark II, available from Columbian Carbon Co.), and about 20 parts by weight of arylsulfonamide formaldehyde adduct (Santolite MHP, available from Monsanto Co.). After melting and preliminary mixing, the toner composition is fed to a rubber mill and thoroughly milled to yield a uniformly dispersed composition of the carbon black in the resin body. The resulting mixture is then cooled and finely subdivided in a jet pulverizer to yield toner particles having an average particle size ranging between about 10 to about 20 microns. The toner has a blocking temperature of about 130° F. About 1 part of the pulverized toner particles are mixed with about 99 parts by weight of the carrier beads of Example I and substituted for the developer in the testing machine described in Example I. Under substantially identical test conditions, it is found that the minimum fuser temperature at which legible copies are obtained with this toner is about 315° F. The maximum fuser temperature at which hot offset to the fuser roll occurs is found to be about 410° F. These results clearly indicate that this toner enables a reduction of about 65° F from the fuser temperature required for the control sample of Example I. The toner dispense well and high resolution images substantially free from background are obtained.

EXAMPLE IV

A toner composition is prepared comprising about 61 parts by weight of a copolymer of about 65 parts by weight of styrene and 35 parts by weight of butyl methacrylate, about 9 parts by weight of carbon black (Neo Spectra Mark II, available from Columbian Carbon Co.), and about 30 parts by weight of arylsulfonamide formaldehyde adduct (Santolite MHP, available from Monsanto Co.). After melting and preliminary mixing, the toner composition is fed to a rubber mill and thoroughly milled to yield a uniformly dispersed composition of the carbon black in the resin body. The resulting mixture is then cooled and finely subdivided in a jet pulverizer to yield toner particles having an average particle size ranging between about 10 to about 20 microns. The toner has a blocking temperature of about 130° F. About 1 part of the pulverized toner particles are mixed with about 99 parts by weight of the carrier beads of Example I and substituted for the developer in the testing machine described in Example I. Under substantially identical test conditions, it is found that the minimum fuser temperature at which legible copies are obtained with this toner is about 310° F. The maximum fuser temperature at which hot offset to the fuser roll occurs is found to be about 405° F. These results clearly indicate that this toner enables a reduction of about 70° F from the fuser temperature required for the control sample of Example I. The toner dispenses well and high resolution images substantially free from background are obtained.

EXAMPLE V

A toner composition is prepared comprising about 51 parts by weight of a copolymer of about 65 parts by weight of styrene and 35 parts by weight of butyl methacrylate, about 9 parts by weight of carbon black (Neo Spectra Mark II, available from Columbian Carbon Co.), and about 40 parts by weight of arylsulfonamide formaldehyde adduct (Santolite MHP, available from Monsanto Co.). After melting and preliminary mixing, the toner composition is fed to a rubber mill and thoroughly milled to yield a uniformly dispersed composition of the carbon black in the resin body. The resulting mixture is then cooled and finely subdivided in a jet pulverizer to yield toner particles having an average particle size ranging between about 10 to about 20 microns. The toner has a blocking temperature of about 130° F. About 1 part of the pulverized toner particles are mixed with about 99 parts by weight of the carrier beads of Example I and substituted for the developer in the testing machine described in Example I. Under substantially identical test conditions, it is found that the minimum fuser temperature at which legible copies are obtained with this toner is about 300° F. The maximum fuser temperature at which hot offset to the fuser roll occurs is found to be about 390° F. These results clearly indicate that this toner enables a reduction of aout 80° F from the fuser temperature required for the control sample of Example I. The toner dispenses well and high resolution images substantially free from background are obtained.

EXAMPLE VI

A control toner composition is prepared comprising about 91 parts by weight of a copolymer of about 80 parts by weight of styrene and 20 parts by weight of isobutyl methacrylate and about 9 parts by weight of carbon black (Black Pearls L, available from Cabot Corp., Boston, Mass.). After melting and preliminary mixing, the toner composition is fed to a rubber mill and thoroughly milled to yield a uniformly dispersed composition of the carbon black in the resin body. The resulting mixture is then cooled and finely subdivided in a jet pulverizer to yield toner particles having an average particle size ranging between about 10 to about 20 microns. The toner has a blocking temperature of about 140° F. About 1 part of the pulverized toner particles are mixed with about 99 parts by weight of the carrier beads of Example I and substituted for the developer in the testing machine described in Example I. Under substantially identical test conditions, it is found that the minimum fuser temperature at which legible copies are obtained with this toner is about 400° F. The maximum fuser temperature at which hot offset to the fuser roll occurs is found to be about 460° F.

EXAMPLE VII

A toner composition is prepared comprising about 81 parts by weight of a copolymer of about 80 parts by weight of styrene and 20 parts by weight of isobutyl methacrylate, about 9 parts by weight of carbon black (Black Pearls L, available from Cabot Corp., Boston, Mass.), and about 10 parts by weight of arylsulfonamide formaldehyde adduct (Santolite MHP, available from Monsanto Co.). After melting and preliminary mixing, the toner composition is fed to a rubber mill and thoroughly milled to yield a uniformly dispersed composition of the carbon black in the resin body. The resulting mixture is then cooled and finely subdivided in a jet pulverizer to yield toner particles having an average particle size ranging between about 10 to about 20 microns. The toner has a blocking temperature of about 140° F. About 1 part of the pulverized toner particles are mixed with about 99 parts by weight of the carrier beads of Example I and substituted for the developer in the testing machine described in Example I. Under substantially identical test conditions, it is found that the minimum fuser temperature at which legible copies are obtained with this toner is about 340° F. The maximum fuser temperature at which hot offset ot the fuser roll occurs is found to be about 430° F. These results clearly indicate that this toner enables a reduction of about 60° F from the fuser temperature required for the control sample of Example VI. The toner dispenses well and high resolution images substantially free from background are obtained.

EXAMPLE VIII

A toner composition is prepared comprising about 71 parts by weight of a copolymer of about 80 parts by weight of styrene and 20 parts by weight of isobutyl methacrylate, about 9 parts by weight of carbon black (Black Pearls L, available from Cabot Corp., Boston, Mass.), and about 20 parts by weight of arylsulfonamide formaldehyde adduct (Santolite MHP, available from Monsanto Co.). After melting and preliminary mixing, the toner composition is fed to a rubber mill and thoroughly milled to yield a uniformly disperse composition of the carbon black in the resin body. The resulting mixture is then cooled and finely subdivided in a jet pulverizer to yield toner particles having an average particle size ranging between about 10 to about 20 microns. The toner has a blocking temperature of about 140° F. About 1 part of the pulverized toner particles are mixed with about 99 parts by weight of the carrier beads of Example I and substituted for the developer in the testing machine described in Example I. Under substantially identical test conditions, it is found that the minimum fuser temperature at which legible copies are obtained with this toner is about 330° F. The maximum fuser, temperature at which hot offset to the fuser roll occurs is found to be about 420° F. These results clearly indicate that this toner enables a reduction of about 70° F from the fuser temperature required for the control sample of Example VI. The toner dispenses well and high resolution images substantially free from background are obtained.

EXAMPLE IX

A toner composition is prepared comprising about 61 parts by weight of a copolymer of about 80 parts by weight of styrene and 20 parts by weight of isobutyl methacrylate, about 9 parts by weight of carbon black (Black Pearls L, available from Cabot Corp., Boston, Mass.), and about 30 parts by weight of arylsulfonamide formaldehyde adduct (Santolite MHP, available from Monsanto Co.). After melting and preliminary mixing, the toner composition is fed to a rubber mill and thoroughly milled to yield a uniformly dispersed composition of the carbon black in the resin body. The resulting mixture is then cooled and finely subdivided in a jet pulverizer to yield toner particles having an average particle size ranging between about 10 to about 20 microns. The toner has a blocking temperature of about 140° F. About 1 part of the pulverized toner particles are mixed with about 99 parts by weight of the carrier beads of Example I and substituted for the developer in the testing machine described in Example I. Under substantially identical test conditions, it is found that the minimum fuser temperature at which legible copies are obtained with this toner is about 320° F. The maximum fuser temperature at which hot offset to the fuser roll occurs is found to be about 410° F. These results clearly indicate that this toner enables a reduction of about 80° F from the fuser temperature required for the control sample of Example VI. The toner dispenses well and high resolution images substantially free from background are obtained.

EXAMPLE X

A toner composition is prepared comprising about 51 parts by weight of a copolymer of about 80 parts by weight of styrene and 20 parts by weight of isobutyl methacrylate, about 9 parts by weight of carbon black (Black Pearls L, available from Cabot Corp., Boston, Mass.), and about 40 parts by weight of arylsulfonamide formaldehyde adduct (Santolite MHP, available from Monsanto Co.). After melting and preliminary mixing, the toner composition is fed to a rubber mill and thoroughly milled to yield a uniformly dispersed composition of the carbon black in the resin body. The resulting mixture is then cooled and finely subdivided in a jet pulverizer to yield toner particles having an average particle size ranging between about 10 to about 20 microns. The toner has a blocking temperature of about 140° F. About 1 part of the pulverized toner particles are mixed with about 99 parts by weight of the carrier beads of Example I and substituted for the developer in the testing machine described in Example I. Under substantially identical test conditions, it is found that the minimum fuser temperature at which legible copies are obtained with this toner is about 310° F. The maximum fuser temperature at which hot offset to the fuser roll occurs is found to be about 400° F. These results clearly indicate that this toner enables a reduction of about 90° F from the fuser temperature required for the control sample of Example VI. The toner dispenses well and high resolution images substantially free from background are obtained.

EXAMPLE XI

Samples of the developer compositions of Examples I-V are employed in the copying machine described in Example I to make copies of a standard test image. The standard test patterns are printed to provide an integrated optical density as determined with a Welch Densitometer, Model 3834, of $1.2 \pm 0.1$. The degree of fix at various temperatures employing the fuser unit described in Example I is evaluated. The results are reported in "Taber Cycles" required to reduce the initial density by 20 percent. The results are as indicated below in Table I.

Table I

| | Average Taber Cycles | | | | |
|---|---|---|---|---|---|
| Temp. ° F | Example 1 | 2 | 3 | 4 | 5 |
| 290 | — | — | 5 | 7 | 6 |

Table I-continued

| Temp. ° F | Average Taber Cycles Example 1 | 2 | 3 | 4 | 5 |
|---|---|---|---|---|---|
| 300 | — | 3 | 8 | 8 | 12 |
| 310 | — | 5 | 9 | 12 | 15 |
| 320 | 8 | 14 | 18 | 18 | |
| 330 | 3.0 | 16 | 17 | 22 | 21 |
| 350 | 3.5 | 20 | 23 | 29 | 27 |
| 360 | 4.5 | 24 | 31 | 37 | 30 |
| 370 | 6.0 | 29 | 31 | 37 | 34 |
| 380 | 8.0 | 31 | 33 | 39 | 38 |
| 390 | 14.0 | 32 | 32 | 38 | 45 |
| 400 | 17.0 | 40 | 30 | 35 | — |
| 410 | 19.5 | 43 | 41 | 50 | — |
| 420 | 20.5 | — | — | — | — |

From the above results, it is readily apparent that the minimum acceptable fix level of 10 ± 2 Taber Cycles may be obtained with the toner compositions of this invention at a reduction of about 60° F. In addition, at comparable fixing temperatures, the average number of Taber Cycles obtained is significantly higher.

EXAMPLE XII

The glass transition temperature of a copolymer resin comprising about 65 parts by weight of styrene and about 35 parts by weight of butyl methacrylate was determined using a Differential Scanning Calorimeter, 10° c/min. heating rate, and 4 mcal./sec. sensitivity. Measurements were made in a flowing Nitrogen atmosphere and the dial temperatures were converted for thermal lag using the melting point of those crystalline substances as references (octadecone, naphthalene, and p-nitrotoluene). The glass transition temperature of the aforementioned copolymer resin was found to be about 56.6° C. After mixing about 10 parts by weight and about 25 parts by weight, respectively, of an arylsulfonamide formaldehyde adduct (Santolite MHP) based on the total weight of the mixture with the aforementioned copolymer resin, the glass transition temperature of the mixtures was found to be about 58.9° C and 57.5° C, respectively, indicating within experimental error that the addition of the adduct does not significantly affect the glass transition temperature of the copolymer resin and hence the blocking temperature of such a resin-based toner composition is not adversely influenced.

EXAMPLE XIII

The melt viscosity of a copolymer resin comprising about 65 parts by weight of styrene and about 35 parts by weight of butyl methacrylate was determined by using a Ferranti-Shirley Cone and Plate Viscometer. Data are cited at 30 $sec^{-1}$ shear rate. The melt viscosity of the aforementioned copolymer resin at various temperatures was found to be about $8.0 \times 10^3$ poise at 140° C; $3.6 \times 10^3$ poise at 150° C; $1.9 \times 10^3$ poise at 160° C; and $1.1 \times 10^3$ poise at 170° C. After mixing about 25 parts by weight of an arylsulfonamide formaldehyde adduct (Santolite MHP) with the aforementioned copolymer resin, the melt viscosity of the resultant mixture was found to be about $4.9 \times 10^3$ at 130° C; $2.8 \times 10^3$ poise at 140° C; $1.1 \times 10^3$ poise at 150° C; $8.2 \times 10^2$ poise at 160° C; and $4.1 \times 10^2$ poise at 170° C, respectively, indicating, within experimental error, that the addition of the adduct results in betweeen about three to four fold lowerings of the melt viscosity of the copolymer resin. In turn, the melt viscosity change is reflected in substantially lower fusing temperatures of the toner compositions.

The expression "developer material" as employed herein is intended to include electroscopic toner material or combinations of toner material and carrier material.

Although specific materials and conditions are set forth in the foregoing examples, these are merely intended as illustration of the present invention. Various other suitable thermoplastic toner resin components, additives, colorants, and development processes such as those listed above may be substituted for thosse in the examples with similar results. Other materials may also be added to the toner or carrier to sensitize, synergize, or otherwise improve the fusing properties or other desirable properties of the system.

Other modifications of the present invention will occur to those skilled in the art upon a reading of the present disclosure. These are intended to be included within the scope of this invention.

What is claimed is:

1. An electrostatographic imaging process comprising the steps of forming an electrostatic latent image on a surface and developing said electrostatic latent image by contacting said electrostatic latent image with an electrostatographic developer material comprising particles, said particles including finely-divided toner material having a particle size of up to about 30 microns, a melting point of at least about 110° F, a melt viscosity of less than about $2.5 \times 10^{-4}$ poise at temperatures up to about 450° F, said toner material comprising a colorant selected from the group consisting of pigments, dyes, and mixtures thereof, a thermoplastic resin consisting essentially of a vinyl polymer having a melting point of at least about 110° F, and from about 5 percent to about 55 percent by weight, based on the weight of said vinyl polymer, of an arylsulfonamide formaldehyde adduct having a melting point between about 50° F and about 250° F and having the general structure

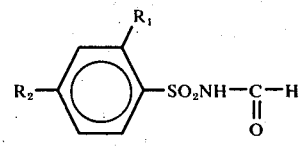

wherein $R_1$ and $R_2$ are either hydrogen or methyl provided that where $R_1$ or $R_2$ is methyl, the other is hydrogen, wherein said adduct reduces the melt viscosity of said toner material but does not reduce its glass transition temperature nor its blocking temperature, whereby at least a portion of said particles are attracted to and held on said surface in conformance to said electrostatic latent image.

2. An electrostatographic imaging process according to claim 1 wherein said vinyl polymer has a weight average molecular weight between about 3,000 to about 500,000.

3. An electrostatographic imaging process according to claim 1 wherein said finely-divided toner particles contain at least about 25 percent by weight, based on the total weight of said thermoplastic resin in said toner, of a styrene resin.

4. An electrostatographic imaging process according to claim 1 wherein said arlysulfonamide formaldehyde adduct is selected from the 2-methylbenzene sulfonamide formaldehyde adduct and the 4-methylbenzene sulfonamide formaldehyde adduct.

5. An electrostatographic imaging process according to claim 1 wherein said colorant is present in an amount of from about 1 to about 20 percent by weight of said toner material.

6. An electrostatographic imaging process according to claim 1 wherein said resin is a copolymer of styrene and an alkyl methacrylate.

7. An electrostatographic imaging process according to claim 1 wherein said finely-divided toner particles are electrostatically coated on the surface of carrier particles having an average particle diameter between about 50 to about 1,000 microns.

8. An electrostatographic imaging process according to claim 7 wherein said developer material comprises about 1 part by weight of said finely-divided toner particles and from about 10 to about 200 parts by weight of said carrier particles.

9. An electrostatographic imaging process comprising the steps of forming an electrostatic latent image on a surface and developing said electrostatic latent image by contacting said electrostatic latent image with an electrostatographic developer material comprising finely-divided toner particles electrostatically coated on a carrier surface capable of retaining said toner particles by electrostatic attraction said toner particles having a particle size range of up to about 30 microns, a blocking temperature of at least about 110° F, a melt viscosity less than about $2.5 \times 10^{-4}$ poise at temperatures up to about 450° F, and comprising a colorant selected from the group consisting of a pigment and a dye, a thermoplastic resin consisting essentially of a vinyl polymer having a melting point at least about 110° F, and from about 5 percent to about 55 percent by weight based on the weight of said vinyl polymer, of an arylsulfonamide formaldehyde adduct having a melting point between about 50° F and about 250° F and having the general structure.

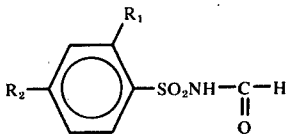

where $R_1$ and $R_2$ are either hydrogen or methyl provided that where $R_1$ or $R_2$ is methyl, the other is hydrogen, wherein said adduct reduces the melt viscosity of said toner material but does not reduce its glass transition temperature nor its blocking temperature, whereby at least a portion of said finely-divided toner particles are attracted to and held on said surface in conformance to said electrostatic latent image.

10. An electrostatographic imaging process comprising the steps of forming an electrostatic latent image on a surface and developing said electrostatic latent image by contacting said electrostatic latent image with an electrostatographic developer material comprising carrier particles and toner particles, said toner particles having a melting point of at least about 110° F, said toner particles comprising a colorant selected from the group consisting of dyes, pigments, and mixtures thereof, a thermoplastic resin consisting essentially of a vinyl polymer having a melting point of at least about 110° F, and from about 5 percent to about 55 percent by weight based on the weight of said vinyl polymer, of a arylsulfonamide formaldehyde adduct having a melting point between about 50° F and about 250° F and having the general structure

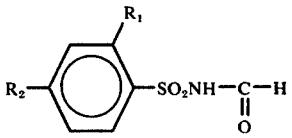

wherein $R_1$ and $R_2$ are either hydrogen or methyl provided that where $R_1$ and $R_2$ is methyl, the other is hydrogen, wherein said adduct reduces the melt viscosity of said toner material but does not reduce its glass transition temperature nor its blocking temperature, whereby at least a portion of said finely-divided toner particles are attracted to and held on said surface in conformance to said electrostatic latent image.

* * * * *